United States Patent [19]

Finn

[11] Patent Number: 4,972,152

[45] Date of Patent: Nov. 20, 1990

[54] APPARATUS AND METHOD FOR TESTING IGNITION MODULES AND COMPONENTS OF GAS BURNERS

[76] Inventor: Edwin R. Finn, 644 E. Riverdale, Orange, Calif. 92665

[21] Appl. No.: 387,765

[22] Filed: Aug. 6, 1989

[51] Int. Cl.[5] ..... G01R 31/28; G01M 19/00

[52] U.S. Cl. ..... 324/511; 73/865.9; 324/502; 324/527; 340/640; 340/652; 340/655; 431/13

[58] Field of Search ..... 73/866.4, 865.9; 324/527-536, 502, 511; 371/23, 15.1; 431/13, 125; 340/640, 635, 652, 653, 654, 655

[56] References Cited

U.S. PATENT DOCUMENTS

| | | | |
|---|---|---|---|
| 2,567,859 | 9/1951 | Ringo | 324/511 |
| 3,236,284 | 2/1966 | Kemper | 431/13 |
| 3,320,440 | 5/1967 | Reed | 371/62 X |
| 3,543,111 | 11/1970 | Harris et al. | 324/511 X |
| 3,597,139 | 8/1971 | Elders | 431/66 |
| 3,902,839 | 9/1975 | Matthews | 431/59 X |
| 3,906,341 | 9/1975 | Getz et al. | 324/502 |
| 3,906,342 | 9/1975 | Pfouts | 324/502 |
| 3,908,117 | 9/1975 | Noruse et al. | 371/18 |
| 4,070,143 | 1/1978 | Dietz | 431/46 X |
| 4,077,762 | 3/1978 | Matthews | 431/43 X |
| 4,626,192 | 12/1986 | Geary | 431/74 X |

FOREIGN PATENT DOCUMENTS

| | | | |
|---|---|---|---|
| 355294 | 6/1922 | Fed. Rep. of Germany | 73/865.9 |
| 3324100 | 1/1985 | Fed. Rep. of Germany | 73/865.9 |

OTHER PUBLICATIONS

"7100 Der Gas Valve Typical Retrofit Wiring", By Robertshaw, p. 7; published by Aug. 1989.

*Primary Examiner*—Tom Noland

*Attorney, Agent, or Firm*—Willie Krawitz

[57] ABSTRACT

An apparatus and method for testing the ignition modules of gas burners is disclosed, and functions without the requirement of a gas feed in the test program. The method involves disconnecting the ignition module from the electrical supply, and from the gas feed, and employing the apparatus of the invention to apply a test voltage to the ignition module, and to various individual components of the system such as the pilot gas valve and main gas valve which are encased in the gas valve, connecting wires, etc. In order to avoid employing gas feed in the test, a simulated gas flame signal is fed to the ignition module under test using a flame simulator device which sends an appropriate signal to the ignitor module. Hence, with the gas feed disconnected, the test method and apparatus of this invention can be used to conduct the test safely, while saving time, and providing a reliable result.

12 Claims, 2 Drawing Sheets

APPARATUS AND METHOD FOR TESTING IGNITION MODULES AND COMPONENTS OF GAS BURNERS

BACKGROUND OF THE INVENTION

This invention relates to a new and improved test method and apparatus for testing ignition modules and components of gas burners.

Ignitor circuits for gas burners have been replacing conventional pilot ignition devices, and typical patents covering these devices are described in U.S. Pat. Nos. 4,626,192; 3,902,839; 4,070,143; and, 4,077,762. Other patents in the general area of ignitor testing include U.S. Pat. Nos. 2,899,675; 3,320,440; 3,597,139; 3,906,341; 3,906,342; and, 3,908,117.

The ignitor control circuits produce sequencing steps for firing a gas burner, the first step of the sequence commencing when a thermostat for the system inputs a demand signal for heat. In the second step of the sequence, and simultaneously with the demand signal, sparking begins, and a pilot gas valve opens to admit fuel gas. In the third step of the sequence, the spark ignites the pilot gas, and the ensuing flame is sensed by a sensor. In the fourth step of the sequence, the sensor opens the main gas valve, and finally, in the fifth step of the sequence, the pilot flame ignites the main gas feed supply.

The ignitor circuits which may be tested by the method and apparatus of this invention include those manufactured by Robertshaw (models SP 715 and SP735), Johnson Controls G60 series, and Honeywell S86 (Y86).

Frequently, if the ignitor circuit does not turn on the gas burner, the entire system of course must be checked to determine the problem, and this involves checking each individual component, including the ignition control module. However, this procedure, while necessary, takes time, say about ½–1 hours, and it would be preferable to complete the test procedure in say 10–15 minutes.

Also, it would be highly desirable to test the system without requiring the presence of a gas feed as part of the test program. Moreover, since one of the main problems associated with failure to turn on the gas burner resides in the ignition control device, a method and apparatus is desired to quickly test this components, since it represents a major potential for failure. By confirming or eliminating at the outset whether the ignition control is or is not at fault, the test program can be greatly accelerated. This would in turn determine whether to replace this component immediately before continuing the test, since it is the most expensive and complex component in the system.

THE INVENTION

According to the invention, the ignition control circuit and transformer power for the circuit are initially disconnected to isolate them from the system, the gas feed supply is turned off, and a separate transformer power and test circuit are connected to the ignition control circuit to be tested. When the power is turned on, the internal circuits in the ignition control circuit module are then tested.

However, since gas is not being sent into the system, a simulated signal must be used instead to recreate the signal produced by an actual flame, for example from a flame simulator device, and this enables a suitable test signal to be applied to the ignition control circuit module under test.

Initially, a test voltage is applied to the thermostat, ignitor and pilot light circuits in the ignition control module, along with a signal from the flame simulator, and if the test apparatus of this invention indicates they are operable, then a test voltage is applied to the main valve circuit. If the main valve circuit is operable, then the ignitor module does not require replacement, otherwise it is replaced. Upon replacement with a new module, if there is no further problem with the system, then wire connectors and burner components do not require testing.

If the ignitor module does not require replacement, or upon replacement, if the furnace does not start, the connecting wires and burner components are tested. Hence, the system can be tested without using burner gas which can pose a hazard, and the test can proceed in a logical, efficient and effective manner.

DESCRIPTION OF THE PREFERRED EMBODIMENTS

Figure 1:
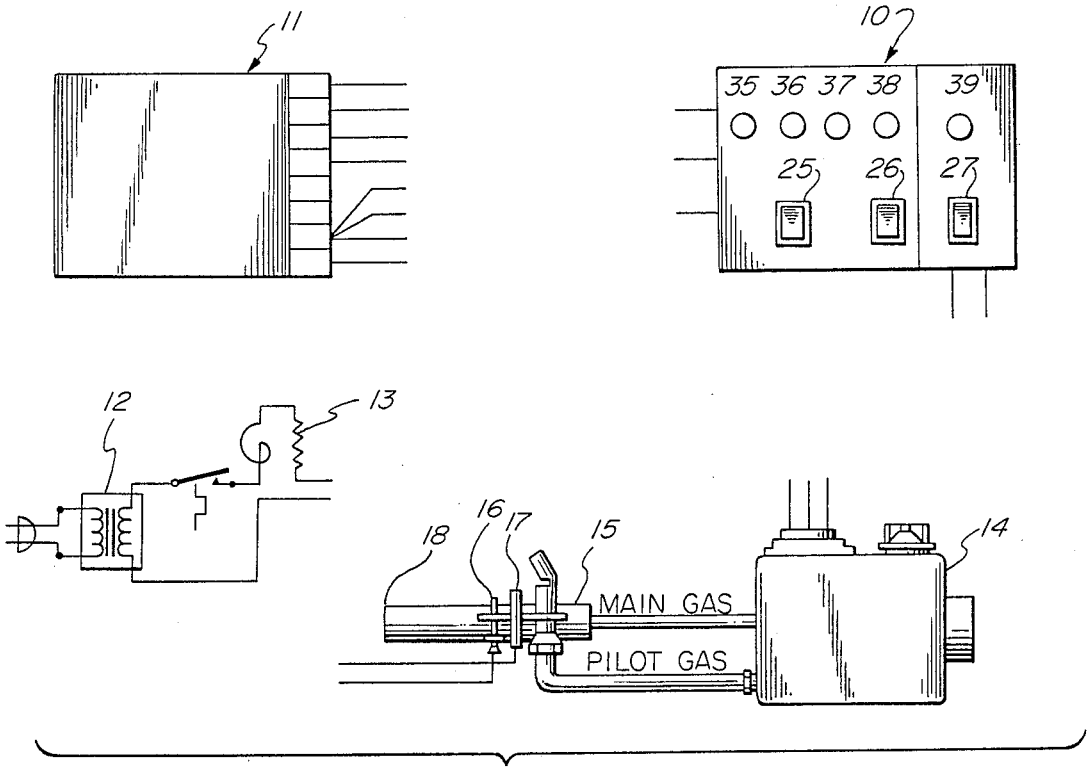
FIG. 1 is a schematic view of an ignition control unit employed in a gas fired system.
Figure 3:
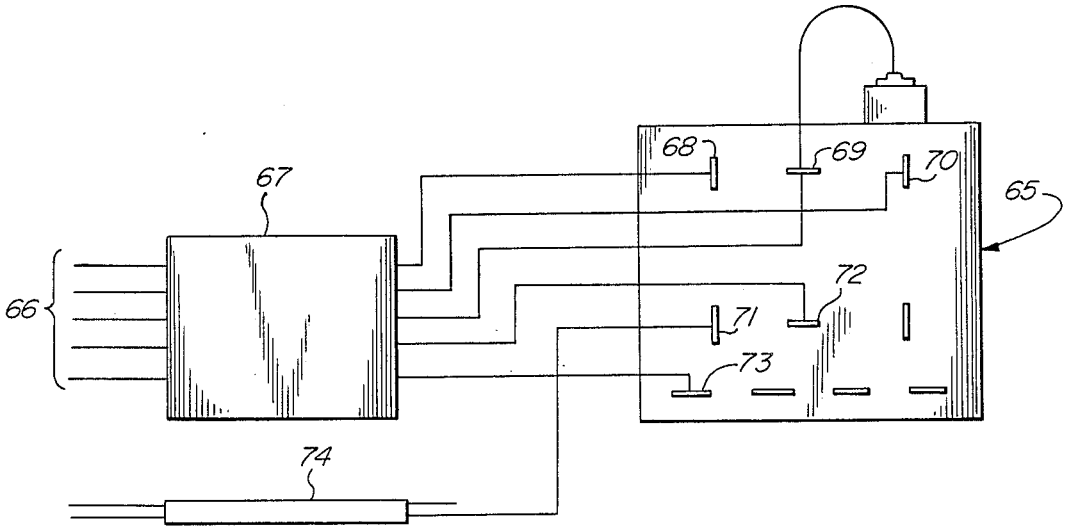

The test module 10 of this invention is shown in FIG. 1 prior to connection to an ignition control unit 11 for test purposes. The ignition control unit is shown following disconnection (except for ground) from the burner system. Typically, these components include a transformer 12, thermostat 13, gas valve 14, pilot burner 15, spark electrode 16, sensor 17 and main burner 18. Following connection to ignitor control units, as shown in FIGS. 2 and 3, testing is commenced.

Figure 2:
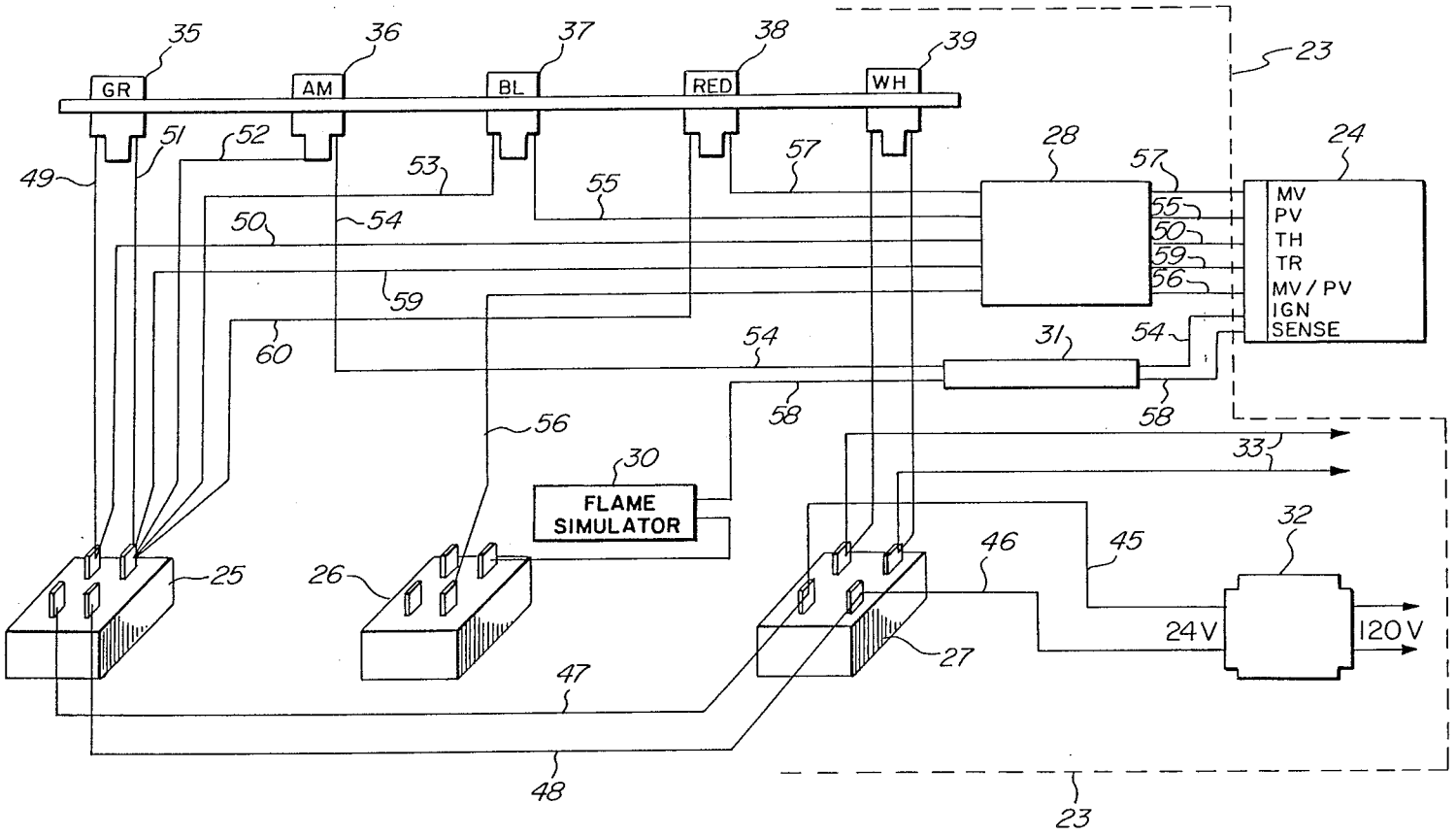
FIG. 2 is a schematic view showing a detailed wiring diagram of the test apparatus of this invention connected to one type of ignition control unit for test purposes; and, FIG. 3 is a schematic view showing the test apparatus connected to another type of ignition control unit for test purposes.

FIG. 2 illustrates the test apparatus 23 of this invention connected to an ignition control module 24 such as the Robertshaw Ignition Control Module SP 715, 780-715, and SP 735 and 780-735 for testing purposes The test apparatus comprises DPST arcoelectric rocker type switches 25, 26 and 27 connected through a wire harness 28 into the ignition control module 24 under test. A flame simulator 30 (Y99 AWl) is also connected through a wire harness 31 to the ignition control module 24, and is actuated through a switch 26. A plug-in transformer 32 powers the test apparatus through switch 25. Test leads 33 are connected to the test apparatus 23 through switch 27, and are powered from the transformer 32 separately from the ignition control module 24. The transformer powers the module (at TH and TR) through switch 25 and wire 59.

Multi-colored light indicators 35, 36, 37, 38 and 39 are mounted on the test apparatus 23, and are connected to the switches 25, 26 and 27, and to the ignition control module 24 through the wire harness 28.

As shown in FIG. 2, following disconnection of transformer 12 from the burner system, it is replaced by transformer 32 which is connected by wires 45, 46 to switch 27, which connects to switch 25 through wires 47, 48. Switch 25 connects to the light indicator 35 (green) by wires 49, 50 and to the module 24 at the TH terminal connection. Switch 25 connects to the indicator light 37 by wire 53. Indicator light 37 connects by wire 55 to the PV terminal on the module 24. Hence, if the thermostat circuit in module 24 is functional, the circuit will be completed, and the indicator lights 35 and 37 will turn on. Indicator light 35 will turn on irrespective of whether module 24 is functional. However, if the light 35 does not turn on, this indicates a lack of power either in the house circuit (e.g., a circuit breaker), or in the transformer, or both.

Similarly, lights 36 (amber) and 37 (blue) are connected by wires 52 and 53 respectively to switch 25. Connecting from the ignition circuit (GN) in module 24 to, the indicator light 36 is wire 54, and the pilot circuit (PV) in the module is connected to light 37 by wire 55. In the same manner as the thermostat circuit in the module 24, if the pilot valve circuit and ignition circuit in the module are functional, indicator lights 36 and 37 will turn on. Obviously, if any of lights 36 and 37 fail to turn on, then the module 24 is defective, and must be replaced. Consequently, with switch 25 closed, and switches 26 and 27 open, the thermostat, spark or ignition circuit and pilot gas valve circuit in the ignition control module can be diagnosed to determine the possible existance of a faulty circuit. The apparatus of this invention thus tests for a complete circuit to indicate the module is functional, and therefore will turn on an indicator light, while failure to turn on an indicator light indicates an incomplete, and therefore a defective circuit.

When switches 25 and 26 are closed, and switch 27 is open, a test of the pilot burner sensor and main gas valve circuits (SENSE, MV, MV/PV) in the module 24 can be made. Light 38 is connected to the switch 25 by a wire 60, and to the MV terminal of module 24 by wire 57. Hence, with the fuel gas supply off, and a flame signal being supplied solely from the flame simulator 30, through wire 58, if indicator light 38 (red) turns on, this indicates that both the sensor circuit and main gas valve circuit are functional in the module 24.

When switches 25 and 26 are off, and with switch 27 being closed, a gas check can be made of the burner components, viz., the pilot gas valve and the main gas valve encased in the gas valve 14; neither of these two components are shown. For this purpose, switch 27 is connected to indicator light 39 (white), and to test leads 33, as mentioned; this will turn on light 39 and indicate power is being supplied to test leads 33. When the test leads 33 are applied to the pilot gas valve and, main gas valve terminals, a distinct clicking sound will indicate these two components are functioning.

FIG. 3 illustrates a similar connection to an ignition control module 65, such as the Johnson series. In this case, a plurality of signal wires, and transformer power wires 66 are fed through a wire harness 67 to various test terminals 68, 69, 70, 71, 72 and 73 for test purposes. Also, a simulated flame signal is fed from a flame simulator (not shown) through a harness 74 to module 65 under test.

It will be appreciated that the test apparatus and method of this invention provides an inexpensive, efficient and logical approach for testing ignition control circuits, without problems associated with using test gas to the system.

I claim:

1. A method for testing a system of an ignition module and associated components of gas burners, comprising disconnecting the ignition module and associated components from respective sources therefor of electrical power and gas feed, applying a test electrical signal, which includes a simulated flame signal, to individual, separate circuits in the ignition module, thereby determining if a specific circuit in the ingnition module is complete, and thereby functional, continuing the testing by applying a test electrical signal to the associated components and connective wires if the ignition module is tested as being functional, and replacing defective components, to restore the system and thereby obtain a test indicating the system is functional.

2. The method of claim 1, in which the circuits tested in the ignition module include thermostat, spark or ignition, pilot burner sensor, main gas valve and pilot valve circuits.

3. The method of claim 2, in which associated components of the gas burner include a pilot gas valve and a main gas valve in the system.

4. The method of claim 3, in which a functional test of the associated components is indicated by an audible sound.

5. The method of claim 2, in which at least one indicator light signal is associated with the test signal.

6. An apparatus for testing a system of an ignition module and associated components of a gas burner, comprising:

a. means to apply a test electrical signal to the ignition module, and to individual circuits therein:

b. means to apply a test simulated flame signal to a spark or ignition circuit in the ignition module; and, c. means to receive output signals from the ignition module arising from application of the test signals thereto, and to indicate or display whether the circuits in the ignition module are complete, and thereby functional or incomplete and therefore defective.

7. The apparatus of claim 6, in which the apparatus is adapted to apply a test electrical signal to the associated components of the gas burner, power transformer for the system, and connecting wires, and to indicate or display if the circuits in the power transformer and connecting wires are complete and thereby functional, or incomplete and, therefore defective, and to obtain an audible signal from the associated components of the gas burner if they are functional.

8. The apparatus of claim 7, in which the ignition module includes: a thermostat circuit, a spark or ignition circuit, a pilot burner sensor circuit, a main gas valve circuit, and a pilot valve circuit.

9. The apparatus of claim 8, in which associated components of the gas burner include a pilot gas valve and a main gas valve.

10. The apparatus of claim 9, in which the means to receive the output signal comprises at least one indicator light.

11. The apparatus of claim 7, in which the audible signal is a series of clicks.

12. The apparatus of claim 6, in which the apparatus is adapted to apply a test elecrical signal to: i. a power transformer circuit for the system; ii. connecting wire circuits; iii. a thermostat circuit, a spark or ignition circuit, a pilot burner sensor circuit, a main gas valve circuit, and a pilot valve circuit; and, iv. associated components of the gas burner, including the pilot gas valve and main gas valve; and, to indicate or display if these circuits are complete and thereby functional, or incomplete and therefore defective; and to obtain an audible signal from the pilot gas valve and main gas valve components of the gas burner if they are functional.

* * * * *